US011361740B2

(12) United States Patent
Jones et al.

(10) Patent No.: US 11,361,740 B2
(45) Date of Patent: Jun. 14, 2022

(54) HAND SHAKER

(71) Applicants: Cheryl Lynn Jones, New Smyrna Beach, FL (US); Daniel Lathery, Louisville, KY (US)

(72) Inventors: Cheryl Lynn Jones, New Smyrna Beach, FL (US); Daniel Lathery, Louisville, KY (US)

( * ) Notice: Subject to any disclaimer, the term of this patent is extended or adjusted under 35 U.S.C. 154(b) by 63 days.

(21) Appl. No.: 16/850,069

(22) Filed: Apr. 16, 2020

(65) Prior Publication Data

US 2021/0193091 A1 Jun. 24, 2021

Related U.S. Application Data

(60) Provisional application No. 62/950,153, filed on Dec. 19, 2019.

(51) Int. Cl.
*G10D 13/06* (2020.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 2,318,460 A * 5/1943 Brief ..... A63H 5/00 446/419
2,644,890 A * 7/1953 Mathilda ..... A63H 33/22 250/462.1
4,306,485 A * 12/1981 Rudkin ..... G10K 3/00 446/419
4,901,617 A * 2/1990 Malone ..... G10D 13/06 84/402
5,323,678 A * 6/1994 Yould ..... G10D 13/06 84/418
6,255,572 B1 * 7/2001 Moghaddam ..... G10D 13/06 446/419
6,512,169 B1 * 1/2003 Santini ..... G10D 13/06 446/418
6,620,991 B1 * 9/2003 Honiball ..... G10D 13/06 84/402
6,858,787 B1 * 2/2005 de Vries ..... B65D 81/365 84/402
D511,354 S * 11/2005 Cohen ..... D17/22
7,910,816 B2 * 3/2011 Glowacki ..... G10D 13/06 84/410
8,242,342 B2 * 8/2012 Bettinelli ..... G10D 13/06 84/402
8,558,097 B2 * 10/2013 Krol ..... G10D 13/06 84/402
8,779,263 B2 * 7/2014 Sallee ..... G10D 13/06 84/402
D831,735 S * 10/2018 Jones ..... D17/22
D879,872 S * 3/2020 Jones ..... D17/22
2021/0193091 A1 * 6/2021 Jones ..... G10D 13/10

* cited by examiner

*Primary Examiner* — Robert W Horn
(74) *Attorney, Agent, or Firm* — Andrew Morabito

(57) ABSTRACT

The present invention is a noise maker comprising: a body comprising: an upper chamber, a lower chamber connected to the upper chamber, a handle connected to the lower chamber, a base connected to the handle; a cover, wherein the cover securely fits around the upper chamber; a first set of noise making elements contained with the upper chamber; and a second set of noise making elements contained within the lower chamber.

8 Claims, 5 Drawing Sheets

HAND SHAKER

CROSS-REFERENCE TO RELATED APPLICATIONS

This application is a continuation—(and claims the benefit of priority under 35 USC 120) of U.S. application Ser. No. 62/950,153 filed Dec. 19, 2019. The disclosure of the prior applications is considered part of (and is incorporated by reference in) the disclosure of this application.

BACKGROUND

The present invention relates to a musical instrument, more specifically, the present invention relates to a musical instrument that is shaken by a user with special needs. The present invention accommodates users with mild to moderate dementia, those with limited grip strength, poor eye sight, or blind individuals.

Handheld items, such as musical instruments, often have a cylindrical handle for a user to hold while using the item. For example, a rain stick or a maraca may be handheld by a user via a cylindrical handle. If the user is vigorously utilizing the handheld item, the user may transfer perspiration, germs, dirt, or other unsanitary particles onto the handle. If the item is then handed to another user for subsequent use, the perspiration, germs, dirt and other unsanitary particles may remain on the handle and thereby be transferred to the subsequent user.

Programs that involve physical activity are important in elder care. Such programs may include music, wherein elderly persons are instructed in the playing of musical instruments. Handheld percussion instruments, such as rain sticks, maracas, drums, etc., are popular instruments for such elder care music programs. But such physical activity programs can expose elderly persons to the above described problem of transferring perspiration, germs, dirt, and other unsanitary particles from one user of a handheld musical instrument to a subsequent user of the handheld musical instrument. And because elderly persons may be at a greater risk for the transfer of communicable diseases (due to their compromised immune systems), this is a particularly dire threat.

Music therapy programs are common forms of treatment for individuals with mild to moderate dementia and for individuals with limited grip strength. Traditional hand shakers are difficult for those with dementia or cognitively impaired patients while participating in music programs as they require intensive movements to create minimal noise.

The present invention allows those with dementia or cognitively impaired patients to produce more sound with less effort. The present invention is easier to hold and is more pleasing to grasp. The present invention encourages participation in music therapy programs by those who can still cognitively process music and rhythm. Hand and arm muscles are trained so that the grip strength of the user improves with use of the present invention. Given the structure of the present invention, accidents as a result of dropping the present invention or hitting a nearby individual is limited.

SUMMARY

The present invention comprises a first noise producing chamber, a second noise producing chamber, a plurality of noise producing items, a shaft, and a stopper. The first noise producing chamber is fixed to the second noise producing chamber. The plurality of noise producing items are housed in both the first noise producing chamber and the second noise production chamber. The shaft is fixed to the second noise producing chamber, opposite the first noise producing chamber. The stopper is fixed to the shaft, opposite the second noise producing chamber. In an alternate embodiment of the present invention, the first noise chamber and second noise producing chamber each comprise a plurality of holes which amplify the sound of the plurality of noise producing items. In another embodiment of the present invention, the first noise producing chamber, the second noise producing chamber, the shaft, and the stopper are covered by a padding.

DETAIL DESCRIPTIONS OF THE INVENTION

Figure 1:
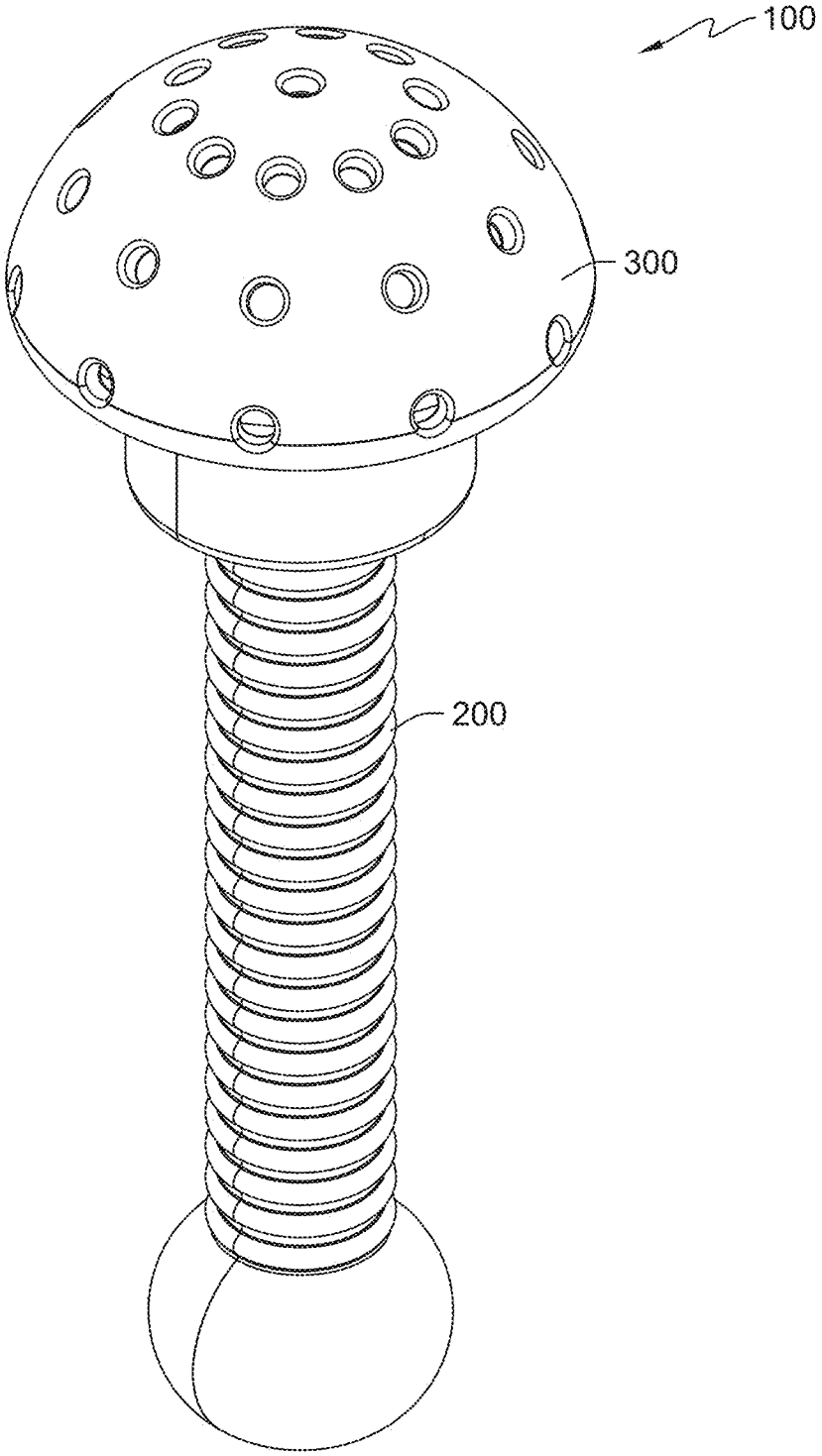
FIG. 1 depicts a perspective view of a hand shaker, in accordance with one embodiment of the present invention.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms “a”, “an”, and “the” include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Programs that involve physical activity are important in elder care. Such programs may include music, wherein elderly persons are instructed in the playing of musical instruments. Handheld percussion instruments, such as rain sticks, maracas, drums, etc., are popular instruments for such elder care music programs. The present invention provides the benefits of assisting those with limited movement, limited gripping strength, or limited sense of touch to be able to be able to use the instrument. Through the design, texture, and features of the present invention, the user is able to safely use the instrument, and the instrument is able to be disinfected after each use to assure the safety of those who are using the instrument. The present invention accommodates users with mild to moderate dementia, those with limited grip strength, poor eye sight, or blind individuals. Or can be used or hit against objects such as a table, arm, or wheelchair to also produce a noise.

Handheld items, such as musical instruments, often have a cylindrical handle for a user to hold while using the item. For example, a rain stick or a maraca may be handheld by a user via a cylindrical handle. If the user is vigorously utilizing the handheld item, the user may transfer perspiration, germs, dirt, or other unsanitary particles onto the handle. If the item is then handed to another user for subsequent use, the perspiration, germs, dirt and other unsanitary particles may remain on the handle and thereby be transferred to the subsequent user. Elderly persons and those with compromised immune systems are more susceptible to illnesses from the transferring of germs and viruses, this is a particularly dire threat. The present invention avoids this situation by providing a design that is safe to clean via a dishwasher or like process without affecting the sound quality of the instrument.

FIG. 1 depicts a perspective view of a hand shaker 100, in accordance with one embodiment of the present invention. The hand shaker 100 is comprised of the body 200 and the cover 300. In the depicted embodiment, the cover 300 is secured around an upper portion of the body 200. In some embodiments, the cover 300 is molded over an upper portion of the body 200. The cover 300 is designed of a soft material to provide protection for the user while using the instrument. The cover 300 is fitted around the body 200 through various manufacturing processes, and is secured in place to reduce the opportunity for the user to remove the cover 300 from the body 200. In one embodiment, the cover 300 is made from a silicon based material.

Figure 2:
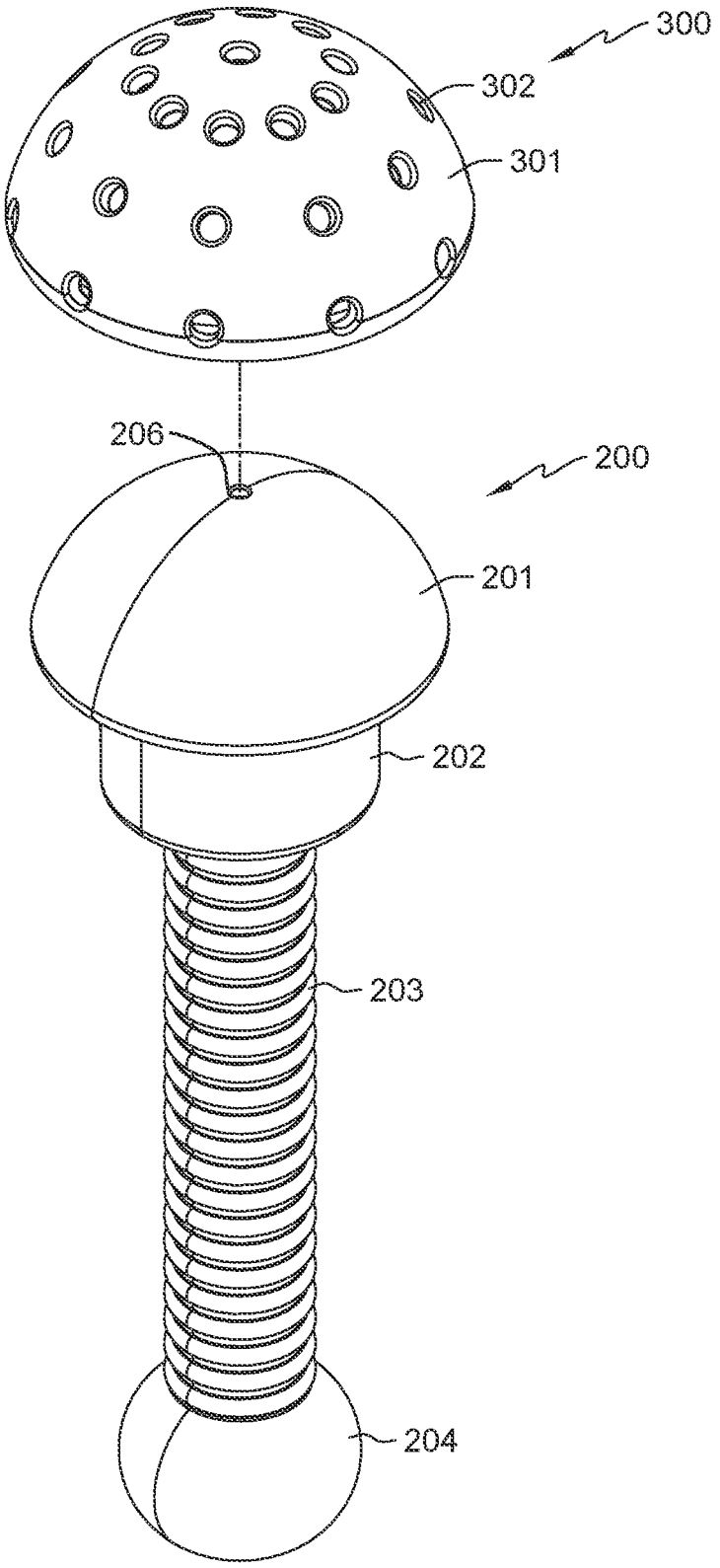
FIG. 2 depicts a perspective exploded view of the hand shaker, in accordance with one embodiment of the present invention.

FIG. 2 depicts a perspective exploded view of the hand shaker 100, in accordance with one embodiment of the present invention. In the depicted embodiment, the cover 300 is show removed from the body 200. The cover has a plurality of openings 301 which allow for the passage of air or water through the cover 300.

The body 200 is comprised of an upper portion 201, a lower portion 202, a handle 203, and the base 204. In the depicted embodiment, the body 200 is a unitary component produced through a single manufacturing process. In additional embodiments, the various components of the body 200 are attached to one another. In some embodiments, the components are removable and replaceable and are secured together through various fastening means.

The upper portion 201 and the lower portion 202 provide for the noise producing features of the instrument. The lower portion 202 is larger than the diameter of the handle 203 to provide a physical que to the user that they have reached the upper end of the handle 203. The size and shape of the upper portion 201 and lower portion 202 is based on the intended sound which the instrument is designed to make. In the depicted embodiment, the upper portion 201 is larger than the lower portion 202. The upper portion 201 has a dome style shape and the lower portion 202 has a cylindrical shape. The shape, size, and volume of the upper portion 201 and the lower portion 202 is variable based on the intended noise of the instrument.

The handle 203 allows a user to grip the present invention and shake both the first noise producing chamber and the second noise producing chamber. The handle 203 is a cylindrical structure that is fixed to the second noise producing chamber, opposite the first noise producing chamber. The handle 203 comprises a plurality of ridges that traverse across the handle 203. The plurality of ridges increase the friction between the user's grip and the present invention. The plurality of ridges also assist with a user's circulation. Alternate embodiments of the handle 203 may comprise a variety of friction inducing members and surfaces. In one embodiment of the handle 203 is flexible.

The base 204 alerts the user that his or her grip is nearing the corresponding end of the handle 203. The base 204 is a body with a diameter larger than that of the handle 203. The base 204 is fixed to the handle 203, at the opposite end of the second noise producing chamber. Due to the larger diameter of the base 204 than that of the handle 203. In one embodiment of the base 204 is a ball so that the base 204 does not have any sharp edges, limiting any accidents while using the present invention. Furthermore, In one embodiment of the base 204 comprises foam-like material.

In order to properly use the present invention, the user grips onto the handle 203. The user proceeds to shake the present invention. As the user shakes the present invention, the plurality of noise producing items within the first noise producing chamber and the second noise producing chamber collide with one another and the inner surfaces of the respective chambers creating noise. As the user's grip slides towards the ends of the handle 203, the user's hand comes in contact with the base 204 thereby alerting the user that his or her grip is slipping. As the user shakes the present invention, the user's circulation is enhanced, the user's hand and arm strength is reinforced, and the user's attention is taken by the noise emitted by the present invention.

The cover 300 has a surface 301 with a plurality of apertures 302 to assist in producing the proper sound and also to permit water to enter the body 200 for an easier cleaning process.

Figure 3:
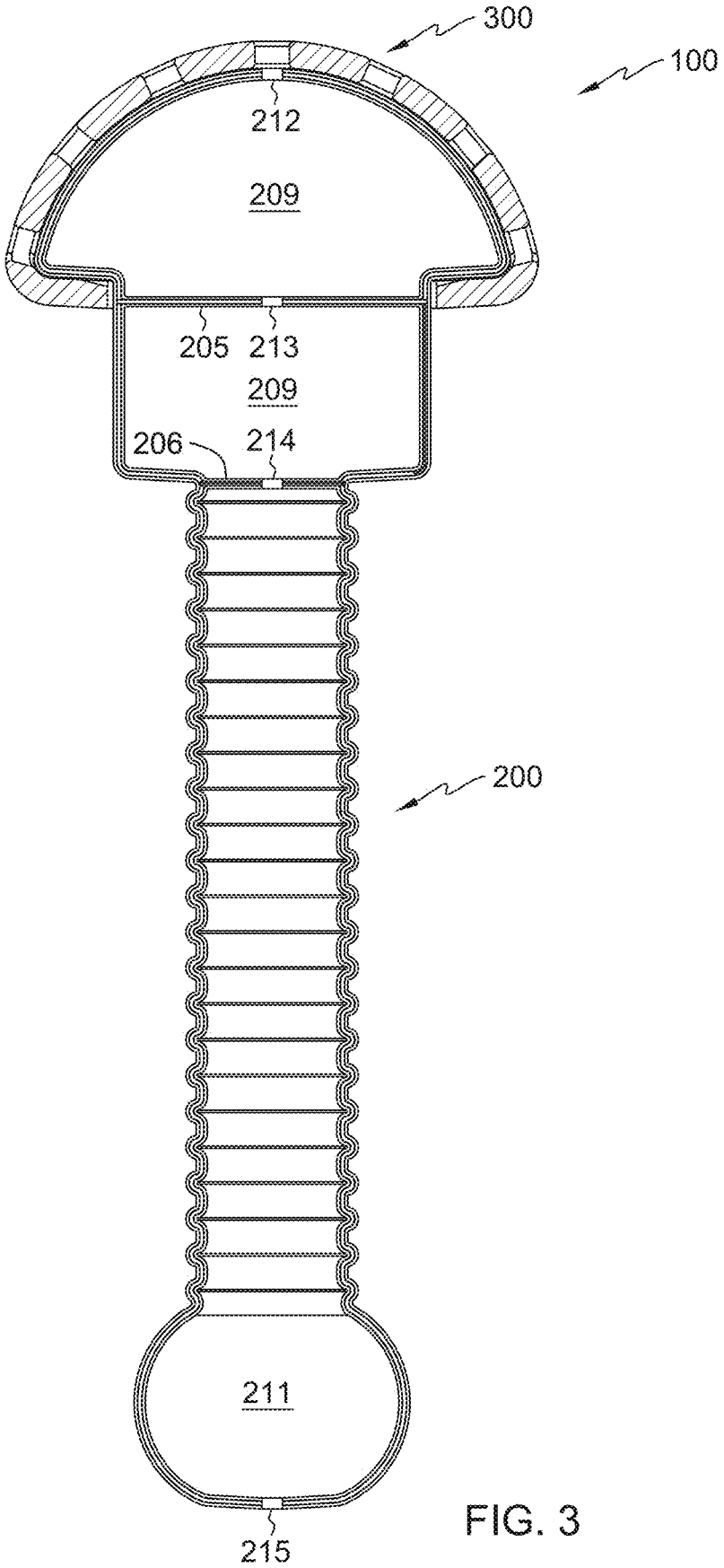
FIG. 3 depicts a section view of the hand shaker assembly, in accordance with one embodiment of the present invention.

FIG. 3 depicts a section view of the hand shaker assembly 100, in accordance with one embodiment of the present invention. The cover 300 is shown substantially covering the upper portion 201 and extends around the lower edge of the upper portion 201, so that the cover 300 is secured around the upper portion 201. In some embodiments, the cover 300 extends around the lower portion 202 as well. Within the hand shaker 100, the upper portion 201 has is hollow, the lower portion 202 is hollow and separate from the upper portion 201 and the handle 203 and the base 204 are hollow and separate from the lower portion 202. Dividers 205 and 206 separate the sections from one another. Openings 212, 213, 214, and 215 permit the passage of water through the device. These apertures do not allow the transfer of the noise producing elements 207 (shown in FIG. 4). The depicted locations are merely shown for exemplary purposes and may be relocated. In additional embodiments, there may be additional openings on surfaces 201, 205, 206, and on the bottom surface where opening 215 is present. This allows for the entire instrument (both inside and outside) to be sterilized when cleaning, and allow for the passage of air and water to maintain an equal atmospheric pressure when in use and when being sterilized.

Figure 4:
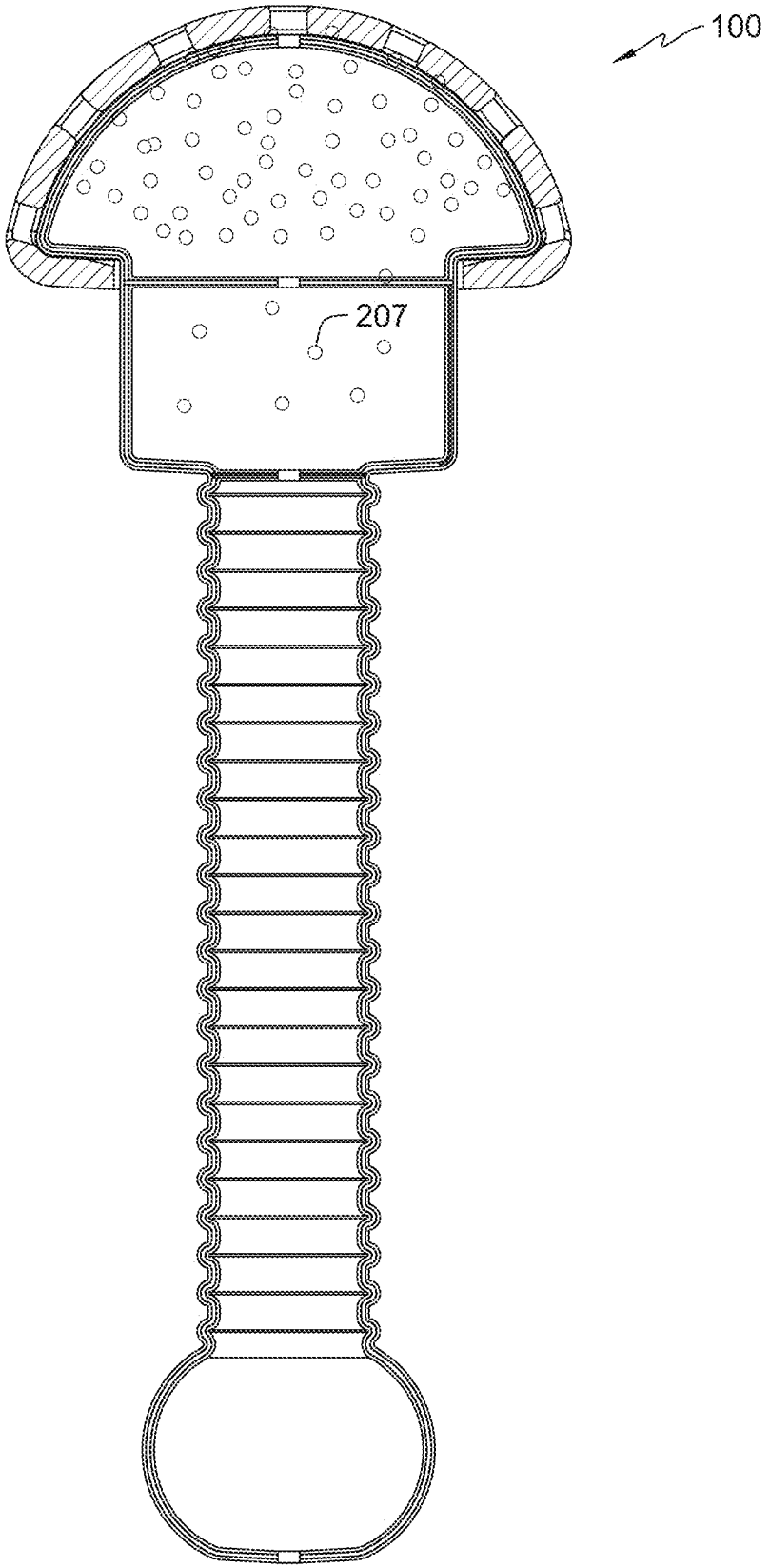
FIG. 4 depicts a section view of the hand shaker assembly, in accordance with one embodiment of the present invention.

FIG. 4 depicts a section view of the hand shaker assembly 100, in accordance with one embodiment of the present invention. Shown in the depicted embodiment is a plurality of noise producing elements 207 within the upper chamber 209, a second plurality of noise producing elements 207 within the lower chamber 210, and no noise producing elements within the third chamber 211. The noise producing elements 207 are shown to be substantially the same size. In various embodiments, the noise producing elements 207 may be of varied sizes, materials, and quantities within each of the chambers. In some embodiments, the cover 300 is molded covers the upper and lower chambers The plurality of noise producing elements 207 within the chamber freely move and hit the inner surfaces and one another to produce a noise. The plurality of noise producing elements 207 within the chambers do not traverse into the other chambers. In an embodiment, the plurality of noise producing elements 207 are beads. However, it is understood that the plurality of noise producing elements 207 may be a variety of rigid items that emit a sound upon impact with the interior surfaces of the chambers, and upon impact with one another.

Figure 5:
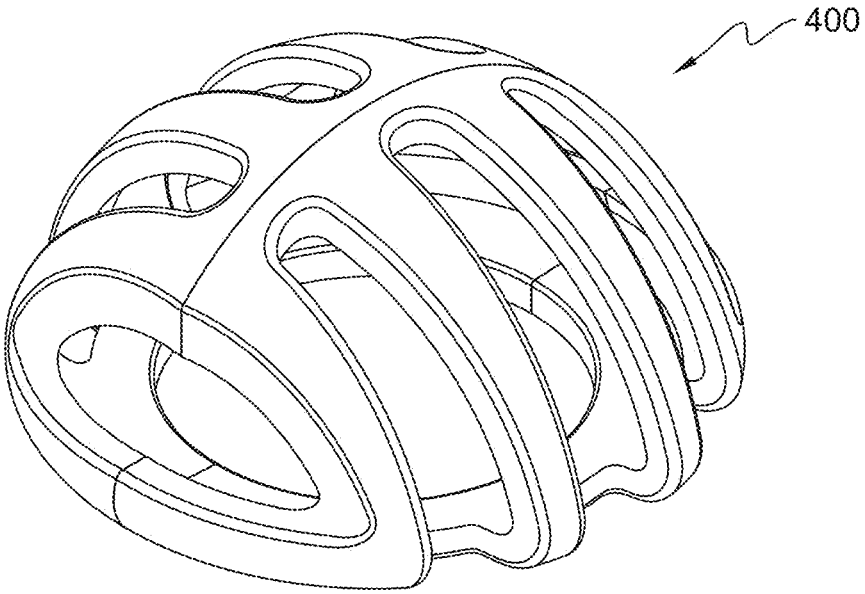
FIG. 5 depicts a perspective view of a cover, in accordance with another embodiment of the present invention.

FIG. 5 depicts a perspective view of a cover 400, in accordance with another embodiment of the present invention. The cover 400 may have varying designs and openings based on the intended use of the instrument as well as the intended look of the instrument.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

The foregoing descriptions of various embodiments have been presented only for purposes of illustration and description. They are not intended to be exhaustive or to limit the present invention to the forms disclosed. Accordingly, many modifications and variations of the present invention are possible in light of the above teachings will be apparent to practitioners skilled in the art. Additionally, the above disclosure is not intended to limit the present invention. In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between network connections of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

The invention claimed is:

1. A noise maker comprising:

a body comprising:

an upper chamber, a lower chamber connected to the upper chamber, a handle connected to the lower chamber, a base connected to the handle;

a cover, wherein the cover securely fits around the upper chamber;

a first set of noise making elements contained with the upper chamber; and a second set of noise making elements contained within the lower chamber.

2. The noise maker of claim 1, wherein the cover has a plurality of apertures.

3. The noise maker of claim 1, wherein a series of apertures permit the transmission of fluid through the body.

4. The noise maker of claim 1, wherein the handle has a predetermined profile.

5. The noise maker of claim 1, wherein the base has a diameter greater than that of the handle.

6. The noise maker of claim 5, wherein the lower chamber has a diameter greater than that of the handle.

7. The noise maker of claim 6, wherein the upper chamber has a diameter greater than that of the lower chamber.

8. The noise maker of claim 7, wherein the upper chamber has a substantially dome like design.

* * * * *